US008236111B2

(12) United States Patent
Murakami et al.

(10) Patent No.: US 8,236,111 B2
(45) Date of Patent: Aug. 7, 2012

(54) PRODUCT FOR ENAMELING AND ENAMELED PRODUCT

(75) Inventors: Hidekuni Murakami, Tokyo (JP); Satoshi Nishimura, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 618 days.

(21) Appl. No.: 12/310,937

(22) PCT Filed: Aug. 15, 2007

(86) PCT No.: PCT/JP2007/066218

§ 371 (c)(1),
(2), (4) Date: Apr. 13, 2009

(87) PCT Pub. No.: WO2008/035528

PCT Pub. Date: Mar. 27, 2008

(65) Prior Publication Data

US 2010/0040872 A1 Feb. 18, 2010

(30) Foreign Application Priority Data

Sep. 19, 2006 (JP) ..... 2006-252972

(51) Int. Cl.
*C22C 38/00* (2006.01)
*C22C 38/08* (2006.01)

(52) U.S. Cl. ..... 148/320; 148/332; 148/333; 148/336

(58) Field of Classification Search ..... None
See application file for complete search history.

(56) References Cited

U.S. PATENT DOCUMENTS 5,993,974 A * 11/1999 Fukushima et al. ..... 428/433

FOREIGN PATENT DOCUMENTS

| | | |
|---|---|---|
| JP | 36-19385 | 10/1961 |
| JP | 53-108023 | 9/1978 |
| JP | 63-18086 | 1/1988 |
| JP | 63-195284 | 8/1988 |
| JP | 63-293173 | 11/1988 |
| JP | 1-316470 | 12/1989 |
| JP | 10-121141 | 5/1998 |
| JP | 2000-1745 | 1/2000 |
| JP | 2006-37215 | 2/2006 |

OTHER PUBLICATIONS

International Search Report dated Dec. 11, 2007 issued in corresponding PCT Application No. PCT/JP2007/066218.

* cited by examiner

*Primary Examiner* — Sheeba Ahmed
(74) *Attorney, Agent, or Firm* — Kenyon & Kenyon LLP

(57) ABSTRACT

The present invention provides a product for enameling and an enameled product that achieve adhesion, bubble/black spot defect resistance and fishscale resistance, even when preprocessing and ground coating are omitted, which product comprise a steel sheet having on the surface thereof an oxide film of 0.10 μm to 400 μm thickness comprising oxides of components of the steel sheet, which steel sheet comprises, in mass %, C: 0.0001% to 0.040%, Si: 0.0001% to 0.50%, Mn: 0.001% to 2.00%, P: 0.0001% to 0.10%, S: 0.0001% to 0.060%, Al: 0.0001% to 0.10%, N: 0.0001% to 0.015%, and O: 0.0001% to 0.070%, further comprises one or more of Ni: 0.01% to 2.00%, Co: 0.0005% to 2.00%, Cr: 0.001% to 2.00%, Cu: 0.01% to 2.00%, Mo: 0.0001% to 2.00%, and Ti: 0.0005% to 0.50%, where Ni+Co+Cr/2+Cu+Mo+Ti: 0.010% to 8.0%, the balance being Fe and unavoidable impurities.

15 Claims, No Drawings

PRODUCT FOR ENAMELING AND ENAMELED PRODUCT

CROSS-REFERENCE TO RELATED APPLICATIONS

This application is a U.S. national stage application of International Application No. PCT/JP2007/066218, filed Aug. 15, 2007, which claims priority to Japanese Application No. 2006-252972, filed Sep. 19, 2006, herein incorporated by reference.

TECHNICAL FIELD

The present invention provides a product for enameling that is low in cost and excellent in enameling properties (bubble/black spot defect resistance and adhesion) and formability characteristics, an enameled product, and methods of producing the product for enameling and the enameled product.

BACKGROUND ART

An enameled product is made by forming a vitreous enamel layer on the surface of a substrate consisting of a metal such as steel, cast iron, aluminium, copper or stainless steel, and is manufactured by, for example, forming the metal substrate into a desired shape, applying a glaze (frit) to its surface, and firing the result at a high temperature. Enameled products are resistant to scratching, permit ready removal of oil stains and the like, and are excellent in heat resistant, resistance to acids, and resistance to alkalis. They are therefore used in a wide range of applications, including kitchen equipment, tableware, sanitation containers, and interior and exterior building materials.

Steel sheet enameling ordinarily involves preprocessing (degreasing, pickling and plating with Ni, Co or the like), followed by so-called two-coat enameling in which a glaze ground coat is formed first and then a cover coat is formed. Thanks to advances in steel sheet and enameling technologies, a one-coat method that omits the ground coat has also come into practical use in recent years.

The preprocessing has been a major obstacle to cost reduction owing to the increasing cost of effluent processing and related equipment, coming on top of the equipment, chemical solution, energy and other running costs.

A process that reduces preprocessing to only degreasing and conducts glazing by electrostatic coating is in use but practical application is limited to two-coat enameling that, for ensuring adequate adhesion, requires a ground coat containing an element with adhesion enhancing effect such as Ni, Co or Mo.

Japanese Patent Publication (B) No. S36-19385 and Japanese Patent Publication (A) No. S63-195284, for example, teach technologies that eliminate the need for preprocessing by forming an oxide film on the steel sheet. However, they do not achieve sufficient adhesion between the steel sheet and the enamel layer and are also unsatisfactory in bubble/black spot defect resistance and fishscale resistance. The prior art taught by Japanese Patent Publication (B) No. S36-19385 was developed for application to the relatively easy-to-enamel capped steel of the days before continuous casting and cannot be applied to current steels which are difficult to enamel because nearly all are produced by continuous casting. Later, processes were invented that called for soaking the steel sheet in an Ni solution after forming it with an oxide film (e.g., Japanese Patent Publication (A) No. S63-293173) and, as an improved technique, for coating with an anticorrosive oil (e.g., Japanese Patent Publication (A) No. H1-316470), but adhesion, bubble/black spot defect resistance and fishscale resistance remained inadequate and unsatisfactory. As set out in Japanese Patent Publication (A) No. S63-18086, for example, techniques were also introduced that aimed at achieving uniform glaze application by carrying out roughness control so as to produce an anchoring effect, applying an anticorrosive oil, and using the oil decomposition gas generated during firing to buoy up the glaze. However, it was found difficult to consistently realize adhesion, bubble/black spot defect resistance and fishscale resistance on a par with that when conducting preprocessing.

Moreover, Japanese Patent Publication (A) No. S53-108023 discloses a technique directed to eliminating the need for preprocessing by heating the steel sheet at a relatively low temperature (450-580° C.) to remove oil and adhering a glazing agent composed of an oxide of manganese, molybdenum, cobalt, nickel or the like. This technique is premised on the assumption that sandblasting is performed to ensure good adhesion. However, the reference to "adhering a glazing agent composed of an oxide of manganese, molybdenum, cobalt, nickel or the like" means it is a two-coat enameling technique requiring a ground coat and that it is incapable of achieving one-coat enameling without preprocessing.

DISCLOSURE OF THE INVENTION

The present invention was accomplished in light of the aforesaid problems and has as its object to provide a product for enameling, an enameled product and methods for the production thereof, which, even when preprocessing and ground coating are omitted, can achieve adhesion, bubble/black spot defect resistance and fishscale resistance like that in the case of one-coat enameling with preprocessing or two-coat enameling without preprocessing.

In order to overcome the foregoing issues, the inventors enameled steel sheets of various compositions after subjecting them to oxidation, and by examining their enameling properties, acquired the knowledge set forth in 1) to 6) below.

1) Mn segregates at the interface between the steel sheet and the oxide film. Later, when glaze is applied and fired, the interface assumes a finely irregular state.

2) The interface irregularities can be controlled to a desired shape by giving the oxide film a suitable structure.

3) When Nb and/or B is present in the steel sheet, the irregularity of the interface becomes still more preferable, whereby adhesion can be improved.

4) Particulate oxides originating from the glaze precipitate onto the fine irregularities and work effectively to improve adhesion with the enamel layer. Ti, K, Na and/or B included in the glaze can be made to function effectively as precipitation nuclei for the particulate oxides.

5) The particulate oxides improve adhesion between the steel sheet and enamel layer.

6) It goes without saying that good enameling properties (bubble/black spot defect resistance and fishscale resistance) must be achieved and for this the steel sheet needs to be made capable of trapping hydrogen entering it during enamel firing. This requires suitable formation of metallic oxides for producing fine voids in the steel sheet. The steel sheet is used as pressed into various shapes, so that good formability is of course required.

The product for enameling to which the present invention is applied is characterized in comprising a steel sheet having on the surface thereof an oxide film of 0.10 μm to 400 μm thickness comprising oxides of components of the steel sheet, which steel sheet comprises, in mass %, C: 0.0001% to 0.040%,
Si: 0.0001% to 0.50%,
Mn: 0.001% to 2.00%,
P: 0.0001% to 0.10%,
S: 0.0001 to 0.060%,
Al: 0.0001% to 0.10%,
N: 0.0001% to 0.015%, and
O: 0.0001% to 0.070%, further comprising one or more of Ni: 0.01% to 2.00%,
Co: 0.0005% to 2.00%,
Cr: 0.001% to 2.00%,
Cu: 0.01% to 2.00%,
Mo: 0.0001% to 2.00%, and
Ti: 0.0005% to 0.50%, where Ni+Co+Cr/2+Cu+Mo+Ti: 0.010% to 8.0%, the balance being Fe and unavoidable impurities.

Further, the product for enameling to which the present invention is applied is characterized in comprising a steel sheet having on the surface thereof an oxide film of 0.10 μm to 400 μm thickness comprising oxides of components of the steel sheet, which steel sheet comprises, in mass %, C: 0.0001% to 0.0040%,
Si: 0.0001% to 0.10%,
Mn: 0.001% to 1.00%,
P: 0.0001% to 0.050%,
S: 0.0005 to 0.060%,
Al: 0.0001% to 0.010%,
N: 0.0001% to 0.0040%, and
O: 0.0010% to 0.050%, further comprising one or more of Ni: 0.01% to 1.00%,
Co: 0.001% to 1.00%,
Cr: 0.005% to 1.00%,
Cu: 0.01% to 1.00%,
Mo: 0.0005% to 1.00%, and
Ti: 0.0005% to 0.10%, where Ni+Co+Cr/2+Cu+Mo: 0.020% to 4.0%, the balance being Fe and unavoidable impurities.

Further, the product for enameling to which the present invention is applied is characterized in comprising a steel sheet having on the surface thereof an oxide film of 0.10 μm to 400 μm thickness comprising oxides of components of the steel sheet, which steel sheet comprises, in mass %, C: 0.0001% to 0.0040%,
Si: 0.0001% to 0.10%,
Mn: 0.001% to 1.00%,
P: 0.0001% to 0.050%,
S: 0.0005 to 0.060%,
Al: 0.0001% to 0.010%,
N: 0.0001% to 0.0040%,
O: 0.0010% to 0.050%,
Ti: 0.001% to 0.50%, and
the balance of Fe and unavoidable impurities.

BEST MODES FOR WORKING THE INVENTION

The present invention will now be explained in detail with respect to the best modes for working the invention. It should be noted that in the following explanation mass % as termed with respect to the substrate and enamel layer is sometimes denoted simply by %.

The inventors discovered that the foregoing problems can be overcome by optimizing the steel sheet composition so as to form the surface of the steel sheet with an oxide film comprising oxides of components of the steel sheet. This discovery led to the accomplishment of the present invention.

Specifically, the product for enameling to which the present invention is applied is a steel sheet formed on the surface thereof with an oxide film of 0.10 μm to 400 μm thickness comprising oxides of components of the steel sheet and the steel sheet comprises, in mass %, C: 0.0001% to 0.040%, Si: 0.0001% to 0.50%, Mn: 0.001% to 2.00%, P: 0.0001% to 0.10%, S: 0.0001 to 0.060%, Al: 0.0001% to 0.10%, N: 0.0001% to 0.015% and O: 0.0001% to 0.070%, further comprises one or more of Ni: 0.01% to 2.00%, Co: 0.0005% to 2.00%, Cr: 0.001% to 2.00%, Cu: 0.01% to 2.00%, Mo: 0.0001% to 2.00% and Ti: 0.0005% to 0.50%, where Ni+Co+Cr/2+Cu+Mo+Ti: 0.010% to 8.0%, the balance being Fe and unavoidable impurities.

First, explanation will be made with regard to the reasons for adding the components of the steel according to the present invention and the reasons for the numerical limits defined for the components.

C: 0.0001 to 0.040%:

It is conventional knowledge that formability improves with lower C content. In the present invention, C content is made 0.040% or less. To obtain high elongation and r value, it is preferably made 0.0040% or less. The more preferable range is 0.0015% or less. While there is no particular need to specify a lower limit, one of 0.0001% or greater is preferable because C content reduction increases steelmaking cost.

Si: 0.0001 to 0.50%:

Si can be included in a small amount to control the composition of oxides. To obtain this effect, the content is made 0.0001% or greater. On the other hand, excessive content not only tends to impair the enameling characteristics but also forms a large amount of Si oxides poor in ductility in hot rolling and may in some case lower the fishscale resistance, so the content is made 0.50% or less, preferably 0.10% or less.

Mn: 0.001 to 2.00%:

Mn is an important constituent that, as pointed out earlier, segregates at the interface between the steel sheet and the oxide film, and later, when glaze is applied and fired, it makes the interface finely irregular. Particulate oxides originating from the glaze precipitate onto the fine irregularities, thereby improving adhesion with the enamel layer. Simultaneously, Mn is an important component that forms oxides by working in association with the amount of added Nb. Further, it is an element that prevents hot embrittlement due to S at the time of hot rolling. To take advantage of these effects, the Mn content is made 0.001% or greater. As excessive Mn addition degrades enamel adhesion and makes occurrence of bubbles and black spot defects more likely, the upper limit of Mn content is specified as 2.00%. The preferred upper limit is 1.00%.

P: 0.0001 to 0.10%:

P is an element contained as an unavoidable impurity. If the content of P becomes high, it affects the reaction between the glass and steel at the time of firing the enamel. In particular, P segregating in a high concentration at the grain boundaries of the steel sheet may degrade the enamel appearance with bubbles, black spot defects and the like. In the present invention, P content is made 0.10% or less, preferably 0.050% or less.

S: 0.0001 to 0.060%:

S forms Mn sulfides. In particular, coprecipitation of these sulfides with oxides has the effect of making the formation of voids at the time of rolling more efficient, thus improving the fishscale resistance. This element need not be contained at all, i.e., a content of 0% is acceptable, but to obtain the above effect, 0.00001% or greater is necessary. The content is preferably 0.0005% or greater. However, if the content is too high, the effect of the Mn required for controlling the composition of the oxides playing an essential role in the present invention may decline, so the upper limit is made 0.060%.

Al: 0.0001 to 0.10%:

Al is an oxide-forming element. To improve the fishscale resistance as one of the enameling characteristics, it is preferable to include a suitable amount of oxygen in the steel as oxides in the steel material. To obtain this effect, 0.0001% or greater of Al is included. On the other hand, Al is a strong deoxidizing element that if added in a large amount not only would make it difficult to retain the amount of oxygen required in the steel by the present invention but also might degrade fishscale resistance by forming a large amount of Al oxides poor in ductility during hot rolling. Therefore, the Al content is made 0.10% or less. The content is preferably 0.010% or less.

N: 0.0001 to 0.015%:

N, like C, is an interstitial solute element. If included in a large amount, then even if Ti and Nb, and further B or other nitride-forming elements are added, formability tends to deteriorate and production of a non-aging steel sheet becomes difficult. For this reason, the upper limit of N is made 0.015%. Preferably the content is made 0.0040% or less. A lower limit does not particularly have to be set, but the content is preferably made 0.0001% or greater owing to cost concerns.

O: 0.0001 to 0.070%:

O is an element required for formation of oxides. It is an essential element in the present invention because it directly affects fishscale property and formability, and also simultaneously affects fishscale resistance by working in association with, inter alia, the Mn, Al and Nb contents. For these effects to be exhibited, a content of 0.0001% or greater is necessary. Preferably, the content is 0.0010% or greater. On the other hand, if the amount of oxygen becomes high, the high oxygen content directly degrades formability and also increases steelmaking refractory costs. The upper limit is therefore preferably made 0.070%, more preferably 0.050% or less.

Ni: 0.01 to 2.00%, Preferably 0.03 to 1.00%. Ti: 0.0005 to 0.05%, Preferably 0.001 to 0.05%:

Ni and Ti are included in the oxides in combination and have an effect on oxide formation. When the amount thereof is relatively small, they segregate in the oxides to produce a favorable effect of locally varying ductility and hardness.

For the foregoing effect to be obtained with Ni, an Ni content of 0.01% or greater is required, and for it to be obtained Ti, a Ti content of 0.0005% or greater is required. On the other hand, excessive content promotes homogenization of the oxide physical properties, and as this may influence the characteristic effect of the present invention, upper limits are preferably defined. For Ni, the upper limit is 2.00% or less, preferably 1.0% or less. For Ti, the upper limit is 0.50%, preferably 0.10% or less, more preferably 0.050% or less.

Cu: 0.01 to 2.00%:

Cu is included for controlling the reaction of the glass and steel during enamel firing. In one-coat enameling, the Cu segregated at the surface at the time of pretreatment has the effect of promoting microscopic heterogeneity in the reaction, thereby improving adhesion. In two-coat enameling, the action attributable to segregation at the surface is slight but Cu affects microreactions between the underglaze and steel. To obtain these-effects, Cu is added as required to a content of 0.01% or greater. Unintentional excess addition not only inhibits the reaction between the glass and steel but may also degrade formability, so to avoid these detrimental effects the content is preferably made 2.00% or less. The content is preferably 1.0% or less, more preferably 0.03 to 1.0% or less.

Cr: 0.001 to 2.00%

Cr improves formability and also contributes to fishscale resistance enhancement. Cr combines with oxygen to be incorporated in oxides in the manner of a composite, thereby affecting oxide formation. When the amount thereof is relatively small, the Cr segregates in the oxides to produce a favorable effect of locally varying ductility and hardness. However, excessive content promotes homogenization of the oxide physical properties, and as this may influence the effect of the present invention, an upper limit is preferably defined. A Cr content of 0.005% or greater is required to obtain the foregoing effects. The upper limit is preferably set at 2.00% or less, more preferably 1.00% or less, still more preferably 0.005 to 1.00% or less.

Mo: 0.0001 to 2.00%:

Mo is an element that effectively improves corrosion resistance and adhesion with the enamel layer. However, the effects of Mo cannot be obtained when the content thereof is less than 0.0001%. When the Mo content exceeds 2.00%, the corrosion resistance enhancing effect saturates, and excessive Mo addition also increases production cost. The Mo content is preferably 1.00% or less, more preferably 0.0005 to 1.00% or less.

Since other unavoidable impurities may have an adverse effect on material properties and enameling properties, they should be minimized.

$$Ni+Co+Cr/2+Cu+Mo+Ti: 0.010 \text{ to } 8.0\%:$$

The elements must be kept within the range of this formula because their effects are additive. Below this range, preferred effects cannot be realized, and above it, the effects saturate.

When Ti is not included, the following formula has to be applied:

$$Ni+Co+Cr/2+Cu+Mo: 0.020 \text{ to } 4.0\%$$

The elements must be kept within the range of this formula because their effects are additive. Below this range, preferred effects cannot be realized, and above it, the effects saturate.

In the present invention, it is possible to further include one or both of Nb: 0.0005 to 1.00% and B: 0.0002 to 0.0100%.

Nb: 0.0005 to 1.00%:

Nb, like Mn, segregates at the interface between the steel sheet and the oxide film, and later, when glaze is applied and fired, it makes the interface finely irregular. In addition, it is an important element that also has the effect of causing particulate oxides containing Ti, K, Na, B and the like originating from the glaze to precipitate onto the fine irregularities, thereby enabling the oxides to improve adhesion between the steel sheet and the enamel layer. Nb also improves deep drawability by immobilizing C and N and is required for imparting non-aging property and high formability. In addition, the added Nb operates to effectively prevent fishscale by combining with oxygen in the steel to form oxides. A content of 0.0005% or greater is necessary to obtain this effect. However, at high amount of addition, deoxidation occurs at the time of Nb addition, which not only makes it difficult to retain oxides in the steel but also degrades bubble and black spot defect resistance. The upper limit is therefore made 1.00%. The content is preferably 0.001 to 0.20% and more preferably 0.001 to 0.15%.

B: 0.0010 to 0.0300%:

B is an element having effects similar to Nb. For B to produce effects like those of Nb, a content of at least 0.0002% or greater, preferably 0.0010% or greater is required. From the viewpoint of castability, the upper limit is 0.0300% or less. Depending on the amount of Nb, addition of excessive B may, when the Nb content is relatively high, markedly increase the recrystallization temperature, thus making very high-temperature annealing necessary for achieving good formability after cold rolling/annealing and thus degrading annealing productivity. The upper limit of B content is therefore preferably made 0.0100% or less and more preferably 0.0050% or less.

Nb+B×10: 0.020 to 0.2%:

Since the effect of Nb and the effect of B add together, the elements exhibit more preferable effect when present in combination. In terms of their respective contributions, B has 10 times the effect of Nb. On the other hand, addition of Nb and B in combination markedly increases the recrystallization temperature. A lower limit must be satisfied for obtaining an effect, and an upper limit must be satisfied for thoroughly recrystallizing the steel sheet so as to obtain good formability. As explained later, by controlling Nb and B to within this range, the steel sheet surface irregularities can be optimized to increase the enamel adhesion still further.

If one or both of Nb: 0.003 to 1.00% and B: 0.0002 to 0.0100% should be contained, the range defined by the following formula must be satisfied:

$$Ni+Co+Cr/2+Cu+Mo+Nb+Ti+B\times10: 0.010 \text{ to } 8.0\%.$$

If one or both of Nb: 0.0005 to 0.20% and B: 0.0010 to 0.0050% should be contained, the range defined by the following formula must be satisfied:

$$Ni+Co+Cr/2+Cu+Mo+Nb+Ti+B\times10: 0.020 \text{ to } 4.0\%.$$

The elements must be kept within the range of this formula because, as mentioned above, their effects are additive. Below this range, preferred effects cannot be realized.

In the present invention, as mentioned earlier, an oxide film comprising oxides of components of the steel sheet is formed on the surface of the steel sheet. If this oxide film has a thickness of less than 0.10 μm, the formation of fine irregularities at the interface between the steel sheet and oxide film is insufficient, so that the particulate oxide precipitation is insufficient, with the result that no adhesion enhancing effect is obtained. On the other hand, if the thickness is greater than 400 μm, the adhesion is lowered because a thick oxide film remains even after firing. The oxide film thickness is preferably 0.5 to 100 μm and more preferably 1.0 to 50 μm. The measurement of oxide film thickness was done by observing a cross-section of the steel sheet with a microscope, measuring the oxide film at 10 arbitrary points within an arbitrary 50 μm span, and calculating the average of the measured values.

Regarding the film, preferably the thickness of the oxide film layers is such that $FeO>Fe_3O_4>Fe_2O_3$, (FeO thickness)/($Fe_3O_4$ thickness)≧1.1, and ($Fe_3O_4$ thickness)/($Fe_2O_3$ thickness)≧1.1. Moreover, it is preferable for the outermost surface of the oxide film comprising oxides of components of the steel sheet not to be covered by FeO but to be covered by $Fe_2O_3$ or $Fe_3O_4$. Further, after formation of the enamel layer, it is preferable for the main constituent of the oxide film layer in contact with the enamel layer to be FeO.

FeO, $Fe_3O_4$ and $Fe_2O_3$ are in some cases present as discrete layers, while in other cases the layers are present in an intermingled condition. Cases in which FeO, $Fe_3O_4$ and $Fe_2O_3$ are represented by the aforesaid relationships exemplify cases in which they are present as discrete layers.

Although the mechanism by which the invention effect is manifestly exhibited when the foregoing is followed is not altogether clear, it is considered to be as follows. It is thought that during firing for forming the enamel layer, oxides in the glaze mix with the steel sheet oxides and lower their melting point. Among the mixtures with FeO, $Fe_3O_4$ and $Fe_2O_3$, those with FeO have the lowest melting point, followed by those with $Fe_3O_4$ and $Fe_2O_3$, and oxides with lower melting points react more easily. Therefore, between FeO and $Fe_3O_4$, FeO is preferably thicker, and between $Fe_3O_4$ and $Fe_2O_3$, $Fe_3O_4$ is preferably thicker, so the thickness relationships were defined as (FeO thickness)/($Fe_3O_4$ thickness)≧1.1, and ($Fe_3O_4$ thickness)/($Fe_2O_3$ thickness)≧1.1.

In the present invention, control of oxygen amount during the aforesaid enamel reaction may further enhance adhesion of the enamel layer by promoting precipitation of oxides originating from elements in the enamel glaze. Typical of these are oxides containing Ti, K, Na or B, which precipitate at the interface as fine particles, thereby making the interface finely irregular. Of particular note is that formation of such special oxides in the invention steel occurs not by the ordinary direct reaction between the steel sheet and glaze but by reaction between the Fe oxides and the glaze under a condition of abundant oxygen and deficient Fe. This is a phenomenon peculiar to the invention steel.

As mentioned earlier, Mn, Nb and B segregate and form fine irregularities at the interface between the steel sheet and the oxide film. During oxide film formation, these elements segregate at the steel sheet surface or the interface between the steel sheet and the oxide film. And they do not simply segregate at the interface but also segregate locally on the interface. This is believed to make the reactions between the oxide film and the base steel sheet and between the oxide film and the enamel heterogeneous, thereby effectively contributing to the formation of fine irregularities. Moreover, it is thought that even during the reaction, these special elements do not completely blend into the molten material but rather segregate on the surface of the reacting oxide film as solids, where they form local galvanic cells and make the interface irregular. In addition, they are believed to act as nuclei for the formation of the aforesaid special oxides and give them their fine particulate shape.

In order to take full advantage of these effects, it suffices to control the irregularities of the interface between the steel sheet and the oxide film after glazing so as to have an average depth of 5.0 μm or less and average distance therebetween of 15 μm or less. As explained earlier, optimum steel sheet surface regularities can be obtained by effecting control to achieve Nb+B×10: 0.020 to 0.2%.

Although the adhesion enhancing mechanism in the invention steel is not altogether clear, it is characterized by change in the fine irregularities at the interface. These irregularities are characterized in being extremely fine and dense in comparison with the state of those at the interface between the base steel sheet and film in the ordinary enameling steel sheet. The depth of the interface irregularities is defined as one of the characteristics. In the present invention, the average depth of the irregularities is made 5.0 μm or less. Although the depth of even the extremely fine irregularities can be observed under close scrutiny, in the present invention a cross-section of the steel sheet is observed with a scanning electron microscope (SEM) and irregularities observable in a 5000× image are measured. Small irregularities measuring 0.1 μm or less are excluded because an accuracy problem arises in measurement using a 5000× photograph. In other words, 0.1 μm and smaller irregularities are ignored. This is nothing more than a rule applied in the measurement and does not mean that smaller irregularities have no effect on adhesion. In the present invention, it is desirable for still finer irregularities to contribute to adhesion improvement and, if anything, desirable for this condition to arise. The irregularity depth measured in this way, is preferably 3.0 μm or less, more preferably 2.0 μm or less, still more preferably 1.0 μm or less, and most preferably 0.5 μm or less. There is no need to set a lower limit and a depth of 0 μm is acceptable. This formation of many irregularities improves adhesion, and the invention effect becomes extraordinarily good when the average pitch of the irregularities 15.0 μm or less, i.e., when 100 or more ridge-valley pairs are present within a length of 1 mm. The average pitch is more preferably 10.0 μm or less, still more preferably 5.0 μm or less, still more preferably 3.0 μm or less, still more preferably 1.0 μm or less, still more preferably 0.5 μm or less, and most preferably 0.2 μm or less. Although no lower limit need be set, the pitch is constrained to 0.05 μm at the minimum because the measurement method ignores irregularities of a depth of 0.25 μm or less. Although it goes without saying that narrower interval and greater depth are fundamentally preferable, reaction anisotropy is hard to maintain and deep and narrow irregularities are easily crushed.

Formation of the aforesaid desired oxide film can be achieved by heating the pressed product concerned for 0.1 to 100 min at a temperature of 500 to 1000° C. in an atmosphere having an oxygen concentration of 5% or greater.

In order to optimize the composition of the iron-system oxides and also to increase productivity by speeding up oxide film formation, the oxygen concentration is preferably 10% or greater, and use of atmospheric air (oxygen concentration: 21%) is acceptable, while even higher oxygen concentrations can be applied. However, an excessively high oxygen concentration increases formation of $Fe_2O_3$ and $Fe_3O_4$, and reduces formation of FeO. The concentration of oxygen contained in oxides should therefore be 50% or less and more preferably 30% or less.

The heating temperature is more preferably made 550 to 900° C. At a temperature above 900° C., the oxide film generated becomes too thick and does not perform adequately. The temperature is still more preferably 600 to 850® C. A relatively high temperature of 650 to 800° C. is used when the steel sheet contains B and a temperature of 550 to 700° C. is used when it does not contain B.

The oxide film formation time is more preferably 0.2 to 30 min and still more preferably 0.3 to 20 min. This is because productivity tends rather to decline at an oxide film formation time longer than 30 min.

The steel sheet roughness is preferably suitably regulated because it also greatly affects the irregularity of the interface between the steel sheet and oxide film after enameling. Maximum advantage can be taken of the adhesion enhancing effect by giving the steel sheet surface a roughness of Ra=0.3 to 5.0 μm. If the roughness is smaller than this, adhesion enhancing effect is slight because the irregularities at the interface between the steel sheet and the oxide film are small, so that little particulate oxide precipitates. The anchoring effect also becomes small. When the roughness falls above the foregoing range, the adhesion enhancing effect saturates and, in addition, appearance may be degraded by occurrence of galling and adhesion of stains during pressing. The roughness is preferably Ra=0.5 to 3.0 μm. However, its being outside this range does not mean that the effect of the present invention cannot be enjoyed. The composition of the glaze is not particularly limited. However, the present invention makes the glaze composition a subject of control because elements of the glaze that precipitate finely at the interface as oxides may work to enhance adhesion. Particularly in a glaze that is chiefly Si oxide, Ti, Na, K and B are the elements that form these fine oxides.

Regarding these elements, the adhesion enhancing effect can be manifested to the utmost by regulating their content to within the ranges of, in mass %, Ti: 0.1 to 20%, Na: 0.1~10%, K: 0.1~10%, B: 0.1~10%, and Ti+Na+K+B: 0.1 to 50%. As explained earlier, these elements contribute favorably to adhesion improvement by forming special oxides with oxides at the steel sheet during reaction of the glaze. If the amount thereof is too small, the special oxides do not form, and if to abundant, the properties of the enamel film itself become undesirable.

When preprocessing is involved, degreasing is ordinarily conducted to ensure platability in the preprocessing. When the glaze is applied by electrostatic coating without preprocessing, heat treatment is conducted for a short time at around 500° C. to vaporize, carbonize and remove the oil component. In the case of the present invention, the compositions of the iron-system oxides (FeO, $Fe_3O_4$ and $Fe_2O_3$) in the oxide film and the thickness of the oxide film are put into a suitable condition by utilizing interaction with the steel sheet components to appropriately regulate the oxidizing reaction between the oil component remaining on the surface and the steel sheet during heating, thereby enabling optimization of the irregularities at the interface between the steel sheet and the oxide film at the time of glazing, and since, by extension, this makes it possible to optimize the condition of the particulate oxides as explained above, it is effective for enhancing the adhesion of the enamel layer. Lubricating oil, anticorrosion oil and the like can be used as the oil. The oil component can be as it is in its adhering condition before heating or can be deliberately applied prior to heating.

The present invention enables omission of preprocessing and ground coating. However, it is also capable of offering adhesion improving effect even when applied to conventional two-coat and one-coat enameling with preprocessing (including shot blasting), two-coat enameling without preprocessing, and other prior art methods. It is particularly useful in connection with high-grade enameled products, which are required to meet demanding adhesion standards.

EXAMPLES

The effect of the present invention will now be concretely explained with respect to Examples of the invention and Comparative Examples falling outside the scope of the invention.

First, as Examples of the present invention, continuously cast slabs having the various chemical compositions shown in Table 1 were hot rolled, cold rolled and annealed under various production conditions, and then temper rolled at a reduction of 1.0% to prepare steel sheets of 0.8 mm thickness. The steel sheet surfaces were formed with an oxide film at this time. Next, the steel sheets were glazed and examined for enameling properties. The glazing consisted of using the powder electrostatic coating method to dry-coat a cover coat glaze to a thickness of 100 μm. No ground coat was applied.

TABLE 1

| Steel No. | Test No | Composition (%) C | Si | Mn | P | S | Al | N | O | Selected elements Ni | Co | Cr | Cu | Mo | Ti |
|---|---|---|---|---|---|---|---|---|---|---|---|---|---|---|---|
| 1 | 1-1 | 0.0036 | 0.0033 | 0.23 | 0.017 | 0.021 | 0.0093 | 0.0034 | 0.055 | | | | | 0.007 | |
| | 1-2 | | | | | | | | | | | | | | |
| | 1-3 | | | | | | | | | | | | | | |
| | 1-4 | | | | | | | | | | | | | | |
| 2 | 2-1 | 0.0010 | 0.031 | 0.37 | 0.008 | 0.045 | 0.0620 | 0.0035 | 0.0032 | | | | 0.022 | 0.008 | 0.119 |
| | 2-2 | | | | | | | | | | | | | | |
| | 2-3 | | | | | | | | | | | | | | |
| | 2-4 | | | | | | | | | | | | | | |
| 3 | 3-1 | 0.035 | 0.027 | 0.23 | 0.018 | 0.019 | 0.049 | 0.0062 | 0.0025 | | | | 0.021 | | |
| | 3-2 | | | | | | | | | | | | | | |
| | 3-3 | | | | | | | | | | | | | | |
| | 3-4 | | | | | | | | | | | | | | |
| 4 | 4-1 | 0.037 | 0.028 | 0.25 | 0.022 | 0.023 | 0.028 | 0.0048 | 0.0021 | | | | 0.017 | | |
| | 4-2 | | | | | | | | | | | | | | |
| | 4-3 | | | | | | | | | | | | | | |
| 5 | 5-1 | 0.0008 | 0.002 | 0.25 | 0.008 | 0.0008 | 0.0025 | 0.0020 | 0.033 | | 0.016 | | 0.005 | | |
| | 5-2 | | | | | | | | | | | | | | |
| | 5-3 | | | | | | | | | | | | | | |
| | 5-4 | | | | | | | | | | | | | | |
| | 5-5 | | | | | | | | | | | | | | |
| | 5-6 | | | | | | | | | | | | | | |
| 6 | 6-1 | 0.0010 | 0.005 | 0.28 | 0.008 | 0.033 | 0.0025 | 0.0024 | 0.037 | 0.023 | | 0.011 | 0.022 | | |
| 7 | 7-1 | 0.0010 | 0.005 | 0.28 | 0.008 | 0.033 | 0.0025 | 0.0024 | 0.037 | | 0.021 | | 0.022 | | |
| 8 | 8-1 | 0.0029 | 0.003 | 0.13 | 0.010 | 0.041 | 0.0029 | 0.0014 | 0.033 | | | | | | 0.012 |
| 9 | 9-1 | 0.0019 | 0.013 | 0.31 | 0.021 | 0.021 | 0.0075 | 0.0037 | 0.048 | 0.013 | | | 0.009 | | |
| 10 | 10-1 | 0.0019 | 0.035 | 0.56 | 0.003 | 0.058 | 0.0037 | 0.0007 | 0.014 | 0.024 | | | | | |
| 11 | 11-1 | 0.0015 | 0.004 | 0.28 | 0.005 | 0.0006 | 0.0014 | 0.0025 | 0.020 | | | | 0.022 | | |
| | 11-2 | | | | | | | | | | | | | | |
| | 11-3 | | | | | | | | | | | | | | |
| | 11-4 | | | | | | | | | | | | | | |
| | 11-5 | | | | | | | | | | | | | | |
| 12 | 12-1 | 0.0006 | 0.002 | 0.14 | 0.003 | 0.016 | 0.0032 | 0.0016 | 0.033 | | | | 0.033 | | |
| 13 | 13-1 | 0.0015 | 0.013 | 0.30 | 0.020 | 0.016 | 0.0091 | 0.0044 | 0.047 | | | | | 0.021 | |
| 14 | 14-1 | 0.002 | 0.035 | 0.38 | 0.006 | 0.043 | 0.062 | 0.002 | 0.0015 | 0.0023 | | | | | |
| 15 | 15-1 | 0.003 | 0.031 | 0.21 | 0.031 | 0.015 | 0.061 | 0.0035 | 0.0021 | 0.0011 | 0.0043 | | | | |
| 16 | 16-1 | 0.051 | 0.021 | 0.031 | 0.015 | 0.023 | 0.031 | 0.0031 | 0.0015 | 2.6 | 4.3 | 2.6 | | | |
| 17 | 17-1 | 0.0008 | 0.035 | 0.25 | 0.025 | 0.041 | 0.051 | 0.0035 | 0.0018 | | | | 0.0011 | | |
| 18 | 18-1 | 0.0018 | 0.016 | 0.041 | 0.018 | 0.034 | 0.041 | 0.0019 | 0.0025 | | | | 0.0018 | | |
| 19 | 19-1 | 0.0023 | 0.015 | 0.25 | 0.015 | 0.0015 | 0.0026 | 0.0021 | 0.016 | 0.01 | | | | | |
| 20 | 20-1 | 0.0021 | 0.054 | 0.35 | 0.025 | 0.0016 | 0.0021 | 0.0013 | 0.024 | 2.3 | 2.1 | | | | |
| 21 | 21-1 | 0.0015 | 0.027 | 0.13 | 0.021 | 0.0019 | 0.0031 | 0.0015 | 0.021 | 0.19 | 3.4 | 1 | | | |
| 22 | 22-1 | 0.0019 | 0.045 | 0.18 | 0.019 | 0.0014 | 0.0049 | 0.0019 | 0.023 | | | | 0.001 | | |
| 23 | 23-1 | 0.0015 | 0.041 | 0.21 | 0.015 | 0.0021 | 0.0037 | 0.0022 | 0.018 | | | | 0.012 | | |
| 24 | 24-1 | 0.0031 | 0.081 | 0.054 | 0.056 | 0.015 | 0.021 | 0.0011 | 0.041 | | | | | | 0.071 |
| 25 | 25-1 | 0.022 | 0.058 | 0.031 | 0.025 | 0.0019 | 0.0049 | 0.0011 | 0.022 | | | | | | 0.022 |
| 26 | 26-1 | 0.008 | 0.031 | 0.21 | 0.022 | 0.021 | 0.015 | 0.0019 | 0.041 | | | | | | |
| 27 | 27-1 | 0.06 | 0.019 | 0.25 | 0.016 | 0.0015 | 0.0051 | 0.0013 | 0.0031 | 0.0025 | | 0.0025 | | | |
| 28 | 28-1 | 0.07 | 0.026 | 0.18 | 0.029 | 0.0011 | 0.018 | 0.0018 | 0.029 | 0.0026 | 0.0034 | | | | |

| Steel No. | Test No | Sub-claim elements Nb | B | Ni + Co + Cr/2 + Cu + Mo + Ti | Ni + Co + Cr/2 + Cu + Mo + Nb + Ti + B × 10 | Nb + B × 10 | Oxide film thickness μm | |
|---|---|---|---|---|---|---|---|---|
| 1 | 1-1 | | | 0.007 | 0.007 | | 0.08 | Comparative |
| | 1-2 | | | | | | 5 | Invention |
| | 1-3 | | | | | | 30 | Invention |
| | 1-4 | | | | | | 450 | Comparative |
| 2 | 2-1 | | | 0.149 | 0.149 | | 0.09 | Comparative |
| | 2-2 | | | | | | 8 | Invention |
| | 2-3 | | | | | | 27 | Invention |
| | 2-4 | | | | | | 420 | Comparative |
| 3 | 3-1 | | | 0.021 | 0.021 | | 0.09 | Comparative |
| | 3-2 | | | | | | 5 | Invention |
| | 3-3 | | | | | | 150 | Invention |
| | 3-4 | | | | | | 500 | Comparative |
| 4 | 4-1 | | | 0.017 | 0.017 | | 0.07 | Comparative |
| | 4-2 | | | | | | 10 | Invention |
| | 4-3 | | | | | | 470 | Comparative |

TABLE 1-continued

| | | | | | | | | |
|---|---|---|---|---|---|---|---|---|
| 5 | 5-1 | 0.085 | | 0.021 | 0.106 | 0.085 | 0.08 | Comparative |
| | 5-2 | | | | | | 7 | Invention |
| | 5-3 | | | | | | 50 | Invention |
| | 5-4 | | | | | | 250 | Invention |
| | 5-5 | | | | | | 380 | Invention |
| | 5-6 | | | | | | 420 | Comparative |
| 6 | 6-1 | 0.086 | | 0.0505 | 0.1365 | 0.086 | 6 | Invention |
| 7 | 7-1 | 0.086 | | 0.043 | 0.129 | 0.086 | 8 | Invention |
| 8 | 8-1 | 0.122 | | 0.012 | 0.134 | 0.122 | 7 | Invention |
| 9 | 9-1 | 0.074 | | 0.022 | 0.096 | 0.074 | 8 | Invention |
| 10 | 10-1 | 0.145 | 0.0015 | 0.024 | 0.184 | 0.16 | 5 | Invention |
| 11 | 11-1 | | 0.0035 | 0.022 | 0.057 | 0.035 | 0.08 | Comparative |
| | 11-2 | | | | | | 7 | Invention |
| | 11-3 | | | | | | 40 | Invention |
| | 11-4 | | | | | | 150 | Invention |
| | 11-5 | | | | | | 450 | Comparative |
| 12 | 12-1 | | 0.0069 | 0.033 | 0.102 | 0.069 | 7 | Invention |
| 13 | 13-1 | | 0.0113 | 0.021 | 0.134 | 0.113 | 8 | Invention |
| 14 | 14-1 | | | 0.0023 | | | 5 | Comparative |
| 15 | 15-1 | | | 0.0054 | | | 30 | Comparative |
| 16 | 16-1 | | | 8.2 | | | 150 | Comparative |
| 17 | 17-1 | 0.0031 | | | 0.0042 | 0.0031 | 40 | Comparative |
| 18 | 18-1 | | 0.988 | | 9.8818 | 9.88 | 8 | Comparative |
| 19 | 19-1 | | | 0.01 | | | 7 | Comparative |
| 20 | 20-1 | | | 4.4 | | | 8 | Comparative |
| 21 | 21-1 | | | 4.09 | | | 7 | Comparative |
| 22 | 22-1 | 0.011 | | | 0.012 | | 150 | Comparative |
| 23 | 23-1 | | 0.5 | | 5.012 | | 40 | Comparative |
| 24 | 24-1 | | | | | | 8 | Comparative |
| 25 | 25-1 | 0.01 | | | | 0.012 | 7 | Comparative |
| 26 | 26-1 | | 0.074 | | | 0.74 | 7 | Comparative |
| 27 | 27-1 | | | | | | 100 | Comparative |
| 28 | 28-1 | | | | | | 150 | Comparative |

The compositions of steels 1 to 13 in Table 1 fall within the present invention. Steels 14 to 28 fall outside the scope of the invention.

Steels 1 to 5 and 11 were each prepared in a number of types (samples) differing in the thickness of the oxide film and each sample was assigned a Specimen No. In each set of samples, one sample was prepared as an invention Example having an oxide film thickness in the range of 0.10 to 400 μm and the remaining samples were prepared as Comparative Examples falling outside this range. The steels (Specimen Nos.) other than Steels 1 to 5 and 11 were prepared to have oxide film thicknesses in the range of 0.10 to 400 μm.

Steels 14 to 16 are Comparative Examples having compositions prescribed by claim 1, and Steels 17 and 18 are Comparative Examples having compositions prescribed by claim 2. Steels 19 to 21 are Comparative Examples having compositions prescribed by claim 3, and Steels 22 and 23 are Comparative Examples having compositions prescribed by claim 4. Steel 24 is a Comparative Example having a composition prescribed by claim 5, and Steels 25 and 26 are Comparative Examples having compositions prescribed by claim 6. Steels 27 and 28 are Comparative Examples whose amounts of added C are 0.05% or greater.

Table 1 also shows the calculation results for Ni+Co+Cr/2+Cu+Mo+Ti, for Ni+Co+Cr/2+Cu+Mo+Nb+Ti+B×10, and for Nb+B×10. Among the calculation results, those that that fall outside the ranges defined by the present invention are indicated by underlining.

The samples designated by the respective Specimen Nos. were evaluated for enameling properties and formability. The results are shown in Table 2. Enameling property was evaluated on three points: adhesion, bubble/black spot defect resistance, and fishscale resistance. Adhesion evaluation was conducted with a drop weight tester by dropping a 16 mm diameter, 1.0 kg dropshot once from a height of 1 m and examining the enamel layer for peeling. The state of peeling of the enamel at the deformed part was measured with 169 contact probes, and the area ratio of the unpeeled parts was determined.

TABLE 2

| | Enameling properties | | | Formability | |
|---|---|---|---|---|---|
| | | Bubble/black | | | |
| Steel No. | Adhesion % | spot defect resistance | Fishscale resistance | Elongation (%) | r value |
| 1-1 | 65 | D | D | 51 | 2.11 |
| 1-2 | 82 | B | B | 51 | 2.16 |
| 1-3 | 77 | B | B | 52 | 2.21 |
| 1-4 | 10 | E | E | 52 | 2.18 |
| 2-1 | 65 | C | D | 55 | 2.24 |
| 2-2 | 80 | B | B | 54 | 2.31 |
| 2-3 | 80 | B | C | 55 | 2.31 |
| 2-4 | 4 | E | E | 55 | 2.34 |
| 3-1 | 60 | C | D | 49 | 1.97 |
| 3-2 | 78 | C | B | 48 | 1.99 |
| 3-3 | 75 | B | C | 48 | 2.01 |
| 3-4 | 10 | E | E | 50 | 2.03 |
| 4-1 | 55 | D | D | 47 | 1.94 |
| 4-2 | 75 | C | C | 48 | 1.99 |
| 4-3 | 5 | E | E | 48 | 1.97 |
| 5-1 | 70 | D | C | 53 | 2.31 |
| 5-2 | 100 | A | A | 52 | 2.35 |
| 5-3 | 90 | A | B | 54 | 2.24 |
| 5-4 | 85 | B | C | 51 | 2.29 |
| 5-5 | 75 | C | C | 53 | 2.26 |
| 5-6 | 10 | E | E | 52 | 2.32 |
| 6-1 | 80 | A | B | 54 | 2.31 |
| 7-1 | 80 | A | B | 54 | 2.34 |
| 8-1 | 80 | B | C | 51 | 2.19 |
| 9-1 | 100 | A | A | 51 | 2.18 |
| 10-1 | 80 | A | B | 55 | 2.31 |
| 11-1 | 70 | D | D | 54 | 2.35 |
| 11-2 | 100 | A | A | 53 | 2.28 |
| 11-3 | 90 | A | B | 55 | 2.36 |
| 11-4 | 85 | B | B | 54 | 2.34 |

TABLE 2-continued

| Steel No. | Adhesion % | Enameling properties: Bubble/black spot defect resistance | Fishscale resistance | Formability: Elongation (%) | r value |
|---|---|---|---|---|---|
| 11-5 | 10 | E | E | 53 | 2.31 |
| 12-1 | 100 | A | A | 55 | 2.35 |
| 13-1 | 100 | A | A | 53 | 2.35 |
| 14-1 | 45 | D | E | 51 | 2.11 |
| 15-1 | 51 | E | D | 51 | 2.11 |
| 16-1 | 23 | D | D | 52 | 2.2 |
| 17-1 | 55 | D | C | 53 | 2.25 |
| 18-1 | 24 | E | D | 53 | 2.26 |
| 19-1 | 44 | D | D | 51 | 2.21 |
| 20-1 | 43 | C | D | 53 | 2.33 |
| 21-1 | 15 | E | E | 53 | 2.31 |
| 22-1 | 55 | D | D | 52 | 2.21 |
| 23-1 | 10 | E | E | 52 | 2.19 |
| 24-1 | 51 | D | D | 51 | 2.15 |
| 25-1 | 16 | E | D | 49 | 1.99 |
| 26-1 | 65 | D | E | 48 | 1.98 |
| 27-1 | 75 | C | C | 43 | 1.51 |
| 28-1 | 80 | C | B | 44 | 1.55 |

Bubble/black spot defect resistance and Fishscale resistanc
A: Outstandingly excellent
B: Excellent
C: Fair
D: Marginally inferior
E: Problematic Bubbles/black spots were visually rated on a five-point scale, with A defined as Outstandingly excellent (substantially no bubble/black spot occurrence), B as Excellent, C as Fair (good enough for practical use), D as Marginally inferior (slightly below practically usable level), and E as Problematic (not practically usable). The performance of the samples achieving A to C ratings was on a par with that of conventional enameled products glazed after preprocessing.

For evaluating fishscale resistance, the fired sheet was placed in a 160° C. constant temperature bath for 10 hours to conduct an accelerated fishscale test, whereafter the occurrence of fishscale was visually observed and rated on a five-point scale, with A defined as Outstandingly excellent (substantially no fishscale occurrence), B as Excellent, C as Fair (good enough for practical use), D as Marginally inferior (slightly below practically usable level), and E as Problematic (not practically usable). The performance of the samples achieving A to C ratings was on a par with that of conventional enameled products glazed after preprocessing.

Formability was evaluated by conducting an ordinary tensile test to assess elongation and Lankford value (hereinafter called "r value).

Among the Steels 1 to 11, those prepared as Comparative Examples having film thickness outside the range of 0.10 to 400 μm, namely, Specimen Nos. 1-1, 1-4, 2-1, 2-4, 3-1, 3-4, 4-1, 4-3, 5-1, 5-6, 11-1 and 11-5, were all found to be inferior in enameling properties. In contrast, among the Steels 1 to 11, those prepared as invention Examples having oxide film thickness within the range of 0.10 to 400 μm prescribed by the present invention all were found to be excellent in all three enameling property aspects, namely, rated C or better in all of adhesion, bubble/black spot defect resistance, and fishscale resistance. Steels 5, 9, 11, 12 and 13, which were added with B, Cu and/or Nb, were particularly excellent in enameling properties.

On the other hand, Specimen Nos. 14-1 to 26-1 composed of Steels 14 to 26 prepared as comparative steels whose compositions fell outside the range prescribed by the present invention were all inferior in enameling properties.

Further, Specimen Nos. 27-1 and 28-1 were very bad in formability (elongation and r value) owing to the increased amount of added C.

Table 3 shows the results of an enameling property test carried out on Steels 2, 5 and 7, which had compositions within the range prescribed by the present invention, with regard to the heating conditions at the time of oxide film formation. Steel 2 was used in Specimen Nos. 2-5 to 2-19, Steel 5 was used in Specimen Nos. 5-7 to 5-16, and Steel 9 was used in Specimen Nos. 9-2 to 9-5.

TABLE 3

Underlining indicates deviation from invention range

| Steel No | Specimen No | Degrease | Steel sheet roughness Ra μm | Heating method: Atmosphere oxygen ratio % | Temp ° C. | Time min | Oxide film condition: Thickness μm | FeO/$Fe_3O_4$ thickness ratio | $Fe_3O_4$/$Fe_2O_3$ thickness ratio |
|---|---|---|---|---|---|---|---|---|---|
| 2 | 2-5 | Yes | 0.25 | 21 (Air) | 520 | 90 | 0.3 | 11.3 | 5.5 |
| | 2-6 | | | | 680 | 4 | 5.2 | 3.5 | 1.7 |
| | 2-7 | | | | 800 | 2 | 10.4 | 4.2 | 2.1 |
| | 2-8 | | 1.4 | 3 | 950 | 90 | 0.08 | — | — |
| | 2-9 | | | 6 | 550 | 80 | 0.3 | 10.9 | 5.2 |
| | 2-10 | | | 21 (Air) | 520 | 90 | 0.3 | 10.6 | 5.4 |
| | 2-11 | | | | 680 | 4 | 5.4 | 3.2 | 1.1 |
| | 2-12 | | | | 800 | 2 | 10.3 | 4.3 | 2.4 |
| | 2-13 | | | | 1050 | 0.15 | 420 | 0.1 | 1.4 |
| | 2-14 | | | 50 | 470 | 90 | 0.08 | — | — |
| | 2-15 | | | | 600 | 10 | 33 | 2.1 | 1.7 |
| | 2-16 | | 3.2 | 21 (Air) | 530 | 80 | 0.3 | 11.1 | 4.9 |
| | 2-17 | | | | 700 | 3 | 4.4 | 3.6 | 1.3 |
| | 2-18 | | | | 550 | 0.05 | 0.09 | — | — |
| | 2-19 | | | | 1060 | 110 | 430 | 0.2 | 1.5 |
| 5 | 5-7 | Yes | 1.3 | 3 | 970 | 90 | 0.07 | — | — |
| | 5-8 | | | 21 (Air) | 520 | 90 | 0.3 | 11.2 | 4.4 |
| | 5-9 | | | | 680 | 4 | 6.3 | 5.1 | 2.3 |
| | 5-10 | | | | 800 | 2 | 11.2 | 4.2 | 2.1 |
| | 5-11 | | | | 1050 | 0.15 | 430 | 0.2 | 1.2 |
| | 5-12 | No | | | 520 | 90 | 0.3 | 10.1 | 5.4 |

TABLE 3-continued

Underlining indicates deviation from invention range

| | | | | | | | | | |
|---|---|---|---|---|---|---|---|---|---|
| | 5-13 | | | | 680 | 4 | 6.3 | 5.3 | 2.6 |
| | 5-14 | | | | 800 | 2 | 11.2 | 4.4 | 2.1 |
| | 5-15 | | | | 550 | 0.05 | 0.07 | — | — |
| | 5-16 | | | | 1040 | 110 | 415 | 0.3 | 1.8 |
| 9 | 9-2 | Yes | 1.3 | 3 | 980 | 80 | 0.08 | — | — |
| | 9-3 | | | 21 (Air) | 520 | 90 | 0.3 | 10.7 | 3.9 |
| | 9-4 | | | | 680 | 4 | 5.7 | 6.7 | 2.1 |
| | 9-5 | | | | 800 | 2 | 10.7 | 5.3 | 1.9 |

| | | Oxide film irregularities | | Enameling properties | | | |
|---|---|---|---|---|---|---|---|
| Steel No | Specimen No | Valley depth μm | Valley interval μm | Adhesion % | Bubble/black spot defect resistance | Fishscale resistance | |
| 2 | 2-5 | 0.1 | 0.5 | 75 | C | C | Invention |
| | 2-6 | 0.5 | 1.2 | 75 | B | C | Invention |
| | 2-7 | 4.2 | 11.4 | 80 | B | C | Invention |
| | 2-8 | Unmeasureable | Unmeasureable | 20 | D | D | Comparison |
| | 2-9 | 0.1 | 0.4 | 75 | C | C | Invention |
| | 2-10 | 0.1 | 0.3 | 75 | C | C | Invention |
| | 2-11 | 2.2 | 7.8 | 85 | B | C | Invention |
| | 2-12 | 6.8 | 17.8 | 75 | C | C | Invention |
| | 2-13 | 8.3 | 19.5 | 10 | E | E | Comparison |
| | 2-14 | Unmeasureable | Unmeasureable | 20 | D | D | Comparison |
| | 2-15 | 0.4 | 0.6 | 80 | C | C | Invention |
| | 2-16 | 0.1 | 0.2 | 75 | C | C | Invention |
| | 2-17 | 4.8 | 13.3 | 80 | B | C | Invention |
| | 2-18 | Unmeasureable | Unmeasureable | 30 | D | D | Comparison |
| | 2-19 | 8.6 | 21.5 | 15 | E | E | Comparison |
| 5 | 5-7 | Unmeasureable | Unmeasureable | 30 | D | D | Comparison |
| | 5-8 | 0.1 | 0.2 | 75 | C | C | Invention |
| | 5-9 | 0.8 | 6.3 | 100 | A | A | Invention |
| | 5-10 | 6.2 | 13.5 | 90 | A | B | Invention |
| | 5-11 | 10.4 | 23.6 | 10 | E | E | Comparison |
| | 5-12 | 0.1 | 0.2 | 80 | B | C | Invention |
| | 5-13 | 0.8 | 6.3 | 100 | A | A | Invention |
| | 5-14 | 6.2 | 13.5 | 95 | A | A | Invention |
| | 5-15 | Unmeasureable | Unmeasureable | 20 | D | E | Comparison |
| | 5-16 | 8.7 | 21.6 | 10 | E | E | Comparison |
| 9 | 9-2 | Unmeasureable | Unmeasureable | 25 | D | D | Comparison |
| | 9-3 | 0.1 | 0.2 | 75 | C | C | Invention |
| | 9-4 | 1.1 | 1.8 | 85 | B | C | Invention |
| | 9-5 | 3.2 | 9.5 | 80 | B | C | Invention |

In the case of Specimen No. 2-8, Specimen No. 5-7 and Specimen No. 9-2, the oxygen concentration during heating was less than 5% and outside the oxygen concentration range prescribed by the present invention. In the case of Specimens Nos. 2-13, 2-14 and Specimen No. 5-11, the atmosphere temperature during the heating was outside the range of 500 to 1000° C. prescribed by the present invention. In the case of Specimen Nos. 2-18, 2-19 and Specimen Nos. 5-15, 5-16, the heating time was outside the range of 0.1 to 100 min. prescribed by the present invention. Specimen Nos. falling outside the scope of the present invention are called Comparative Examples.

Specimen No. 2-8, Specimen No. 5-7 and Specimen No. 9-2, for which the oxygen concentration was low, were found to be inferior in all three enameling properties of adhesion, bubble/black spot defect resistance, and fishscale resistance. Specimens Nos. 2-13, 2-14 and Specimen No. 5-11 for which the heating atmosphere temperature was outside that prescribed by the present invention were also found to be inferior in enameling properties. Specimen Nos. 2-18, 2-19 and Specimen Nos. 5-15, 5-16, for which the heating time was outside that prescribed by the present invention were also found to be inferior in enameling properties.

In contrast, the invention Examples, which were pressed products heated for 0.1 to 100 min at a temperature of 500 to 1000° C. in an atmosphere having an oxygen concentration of 5% or greater, all were found to be excellent in all three enameling property aspects, namely, rated C or better in all of adhesion, bubble/black spot defect resistance, and fishscale resistance. All of the Comparative Examples were also examined regarding oxide film condition, and it was found that the thicknesses of their oxide films fell outside the range of 0.10 to 400 μm. In Table 3, the thickness ratios of $Fe_2O_3$ and $Fe_3O_4$ are shown as the proportions of the total film thickness accounted for by each of $Fe_2O_3$ and $Fe_3O_4$ in the state before enameling. In other words, Table 3 shows (FeO thickness)/($Fe_3O_4$ thickness) and ($Fe_3O_4$ thickness)/($Fe_2O_3$ thickness).

As shown in Table 3, in the case of Specimen Nos. 2-13, 2-19, 5-11 and 5-16, for which the heating was outside the 0.1 to 100 min time range and 500 to 1000° C. temperature range, (FeO thickness)/($Fe_3O_4$ thickness) was found to be below 1.1, and the enameling properties were inferior. In the case of the remaining Specimen Nos., (FeO thickness)/($Fe_3O_4$ thickness) and ($Fe_3O_4$ thickness)/($Fe_2O_3$ thickness) were 1.1 or greater.

The condition of the irregularities at the interface of the oxide film was also examined. In the case of the Specimen Nos. that deviated from the aforesaid heating conditions, either the average irregularity depth was 5.0 μm. or greater or the irregularities were too large to measure.

Table 4 shows how the enameling properties varied with glaze composition in the case of Steels 2 and 5 with compositions in the range stipulated by the present invention. After having been heated for 0.1 to 100 min at a temperature of 500 to 1000° C. in an atmosphere having an oxygen concentration of 5%, Steels 2 and 5 were coated with glazes having the glaze compositions shown in Table 4. Glaze components falling outside the ranges of Ti: 0.1 to 20%, Na: 0.1 to 10%, K: 0.1 to 10% and B: 0.1 to 10% specified in claim 13 are indicated by underlining.

TABLE 4

Underlining indicates deviation from claims

| Specimen No | Steel | Steel sheet roughness Ra μm | Heating method: Atmosphere oxygen ratio % | Heating method: Temp. ° C. | Heating method: Time min | Oxide film condition: Thickness μm | Oxide film condition: FeO/$Fe_3O_4$ thicknes ratio | Oxide film condition: $Fe_3O_4$/$Fe_2O_3$ thickness ratio | Glaze composition: Type | Glaze composition: Ti oxide content % | Glaze composition: K oxide content % | Glaze composition: B oxide content % |
|---|---|---|---|---|---|---|---|---|---|---|---|---|
| 2-20 | 2 | 1.4 | 21 (Air) | 520 | 90 | 0.3 | 11.3 | 5.5 | I | 0.3 | 12 | 13 |
| 2-21 | | | | | | 0.3 | 11.3 | 5.5 | | 0.3 | 8 | 12 |
| 2-22 | | | | | | 0.3 | 11.3 | 5.5 | | 0.2 | 0.3 | 6 |
| 2-23 | | | | | | 0.3 | 11.3 | 5.5 | | 0.4 | 11 | 14 |
| 2-24 | | | | | | 0.3 | 11.3 | 5.5 | | 7 | 7 | 9 |
| 2-25 | | | | | | 0.3 | 11.3 | 5.5 | | 25 | 7 | 8 |
| 2-26 | | | | 680 | 4 | 5.4 | 3.5 | 1.7 | | 0.2 | 12 | 13 |
| 2-27 | | | | | | 5.4 | 3.5 | 1.7 | | 7 | 7 | 9 |
| 2-28 | | | | | | 5.4 | 3.5 | 1.7 | | 7 | 0.3 | 6 |
| 2-29 | | | | | | 5.4 | 3.5 | 1.7 | | 7 | 13 | 15 |
| 2-30 | | | | | | 5.4 | 3.5 | 1.7 | | 7 | 14 | 0.3 |
| 2-31 | | | | | | 5.4 | 3.5 | 1.7 | | 18 | 6 | 7 |
| 2-32 | | | | 800 | 2 | 10.3 | 4.3 | 2.4 | | 7 | 8 | 7 |
| 2-33 | | | | | | 10.3 | 4.3 | 2.4 | | 18 | 7 | 8 |
| 2-34 | | | | 680 | 4 | 5.4 | 3.5 | 1.7 | II | 0.2 | 12 | 13 |
| 2-35 | | | | | | 5.4 | 3.5 | 1.7 | | 7 | 6 | 8 |
| 2-36 | | | | | | 5.4 | 3.5 | 1.7 | | 7 | 0.3 | 6 |
| 2-37 | | | | | | 5.4 | 3.5 | 1.7 | | 7 | 13 | 15 |
| 2-38 | | | | | | 5.4 | 3.5 | 1.7 | | 7 | 14 | 0.3 |
| 2-39 | | | | | | 5.4 | 3.5 | 1.7 | | 18 | 8 | 7 |
| 2-40 | | | | | | 5.4 | 3.5 | 1.7 | | 25 | 7 | 6 |
| 5-17 | 5 | 1.3 | 21 (Air) | 520 | 90 | 0.3 | 11.2 | 4.4 | I | 7 | 8 | 7 |
| 5-18 | | | | | | 0.3 | 11.2 | 4.4 | | 18 | 7 | 6 |
| 5-19 | | | | 680 | 4 | 6.3 | 5.3 | 2.6 | | 0.3 | 12 | 13 |
| 5-20 | | | | | | 6.3 | 5.3 | 2.6 | | 0.3 | 8 | 12 |
| 5-21 | | | | | | 6.3 | 5.3 | 2.6 | | 0.3 | 0.3 | 6 |
| 5-22 | | | | | | 6.3 | 5.3 | 2.6 | | 7 | 6 | 8 |
| 5-23 | | | | | | 6.3 | 5.3 | 2.6 | | 18 | 7 | 6 |
| 5-24 | | | | 680 | 4 | 6.3 | 5.3 | 2.6 | II | 7 | 6 | 8 |
| 5-25 | | | | | | 6.3 | 5.3 | 2.6 | | 7 | 0.3 | 6 |
| 5-26 | | | | | | 6.3 | 5.3 | 2.6 | | 7 | 13 | 15 |
| 5-27 | | | | | | 6.3 | 5.3 | 2.6 | | 18 | 6 | 8 |
| 5-28 | | | | | | 6.3 | 5.3 | 2.6 | | 25 | 7 | 6 |

| Specimen No | Steel | Na oxide content % | Ti + K + B + Na | Oxide film interface irregularities: Depth μm | Oxide film interface irregularities: Valley interval μm | Enameling: Adhesion % | Enameling: Bubble/black spot defect resistance | Enameling: Fishscale resistance | |
|---|---|---|---|---|---|---|---|---|---|
| 2-20 | 2 | 0.3 | 25.6 | 0.1 | 0.2 | 75 | C | C | Invention |
| 2-21 | | 0.3 | 20.6 | 0.3 | 0.4 | 80 | C | B | Invention |
| 2-22 | | 16 | 22.5 | 0.4 | 0.3 | 80 | C | B | Invention |
| 2-23 | | 5 | 30.4 | 0.2 | 0.5 | 80 | B | C | Invention |
| 2-24 | | 8 | 31 | 0.2 | 0.3 | 75 | C | C | Invention |
| 2-25 | | 9 | 49 | 0.4 | 0.3 | 75 | C | C | Invention |
| 2-26 | | 0.3 | 25.5 | 2.3 | 7.5 | 75 | C | C | Invention |
| 2-27 | | 8 | 31 | 0.7 | 0.5 | 85 | B | C | Invention |
| 2-28 | | 17 | 30.3 | 1.3 | 1.9 | 80 | B | C | Invention |
| 2-29 | | 0.2 | 35.2 | 1.4 | 2.1 | 80 | C | C | Invention |
| 2-30 | | 8 | 29.3 | 1.2 | 1.7 | 80 | C | C | Invention |
| 2-31 | | 8 | 39 | 2.1 | 7.8 | 85 | B | C | Invention |
| 2-32 | | 6 | 28 | 1 | 1 | 80 | C | C | Invention |
| 2-33 | | 6 | 39 | 0.5 | 0.8 | 80 | C | C | Invention |
| 2-34 | | 0.3 | 25.5 | 2.6 | 7.8 | 75 | C | C | Invention |
| 2-35 | | 9 | 30 | 1.4 | 2 | 80 | B | C | Invention |
| 2-36 | | 17 | 30.3 | 0.7 | 0.6 | 80 | C | C | Invention |
| 2-37 | | 0.2 | 35.2 | 1.2 | 1.8 | 75 | C | C | Invention |
| 2-38 | | 8 | 29.3 | 1.3 | 1.6 | 80 | B | C | Invention |
| 2-39 | | 5 | 38 | 0.3 | 0.6 | 80 | B | B | Invention |

TABLE 4-continued

Underlining indicates deviation from claims

| | | | | | | | | |
|---|---|---|---|---|---|---|---|---|
| 2-40 | 8 | 46 | 1.9 | 7.8 | 75 | C | C | Invention |
| 5-17 | 5 | 27 | 0.3 | 0.3 | 75 | C | C | Invention |
| 5-18 | 8 | 39 | 1.1 | 0.9 | 75 | C | C | Invention |
| 5-19 | 0.3 | 25.6 | 1.6 | 2.2 | 85 | B | B | Invention |
| 5-20 | 0.3 | 20.6 | 1.5 | 2.3 | 90 | A | B | Invention |
| 5-21 | 16 | 22.6 | 1.7 | 2.1 | 90 | B | B | Invention |
| 5-22 | 9 | 30 | 0.5 | 0.8 | 100 | A | A | Invention |
| 5-23 | 8 | 39 | 1.5 | 1.4 | 95 | A | B | Invention |
| 5-24 | 9 | 30 | 0.4 | 0.2 | 95 | A | B | Invention |
| 5-25 | 17 | 30.3 | 1.2 | 1.3 | 90 | B | B | Invention |
| 5-26 | 0.2 | 35.2 | 1.1 | 1.4 | 90 | B | B | Invention |
| 5-27 | 9 | 41 | 0.7 | 0.5 | 90 | B | B | Invention |
| 5-28 | 8 | 46 | 2.1 | 8.2 | 75 | C | C | Invention |

The enameling properties were found to be good in all cases where the glaze composition was within the range prescribed by the present invention. Particularly noteworthy were Specimen Nos. 5-22 and 5-23, which exhibited adhesion of 95% or greater and also tended to be good in bubble/black spot defect resistance and fishscale resistance. In contrast, when the glaze composition was outside the invention range, the enameling properties tended to be somewhat poorer.

The foregoing Example results demonstrate that the present invention can achieve adhesion, bubble/black spot defect resistance and fishscale resistance comparable to that in the case of one-coat enameling with preprocessing or two-coat enameling without preprocessing, even when preprocessing and ground coating are omitted.

INDUSTRIAL APPLICABILITY

The present invention constituted as set forth in the foregoing enables achievement of adhesion, bubble/black spot defect resistance and fishscale resistance comparable to that in the case of one-coat enameling with preprocessing or two-coat enameling without preprocessing, even when preprocessing and ground coating are omitted.

The invention claimed is:

1. A product for enameling comprising a pressed steel sheet having on the surface thereof an oxide film of 0.10 μm to 400 μm in thickness comprising oxides of components of the steel sheet, wherein the steel sheet comprises, in mass %, C: 0.0001% to 0.040%,
Si: 0.0001% to 0.50%,
Mn: 0.001% to 2.00%,
P: 0.0001% to 0.10%,
S: 0.0001% to 0.060%,
Al: 0.0001% to 0.10%,
N: 0.0001% to 0.015%, and
O: 0.0001% to 0.070%,
further comprises one or more of
Ni: 0.01% to 2.00%,
Co: 0.0005% to 2.00%,
Cr: 0.001% to 2.00%,
Cu: 0.01% to 2.00%,
Mo: 0.0001% to 2.00%, and
Ti: 0.0005% to 0.50%,
where Ni+Co+Cr/2+Cu+Mo+Ti: 0.010% to 8.0%, and a balance being Fe and unavoidable impurities.

2. The product for enameling as set forth in claim 1, wherein the steel sheet further comprises one or both of Nb: 0.0005% to 1.00% and B: 0.0002% to 0.0100%, where Ni+Co+Cr/2+Cu+Mo+Nb+Ti+B×10: 0.010% to 8.0%.

3. A product for enameling comprising a pressed steel sheet having on the surface thereof an oxide film of 0.10 μm to 400 μm in thickness comprising oxides of components of the steel sheet, wherein the steel sheet comprises, in mass %, C: 0.0001% to 0.0040%,
Si: 0.0001% to 0.10%,
Mn: 0.001% to 1.00%,
P: 0.0001% to 0.050%,
S: 0.0005% to 0.060%,
Al: 0.0001% to 0.010%,
N: 0.0001% to 0.0040%, and
O: 0.0010% to 0.050%,
further comprises one or more of
Ni: 0.01% to 1.00%,
Co: 0.001% to 1.00%,
Cr: 0.005% to 1.00%, Cu: 0.01% to 1.00%,
Mo: 0.0005% to 1.00%, and
Ti: 0.0005% to 0.10%,
where Ni+Co+Cr/2+Cu+Mo: 0.020% to 4.0%,
the balance being Fe and unavoidable impurities.

4. The product for enameling as set forth in claim 3, wherein the steel sheet further comprises one or both of Nb: 0.0005% to 0.20% and B: 0.0010% to 0.0050%, where Ni+Co+Cr/2+Cu+Mo+Nb+Ti+B×10: 0.020% to 4.0%.

5. A product for enameling comprising a pressed steel sheet having on the surface thereof an oxide film of 0.10 μm to 400 μm in thickness comprising oxides of components of the steel sheet, wherein the steel sheet comprises, in mass %, C: 0.0001% to 0.0040%,
Si: 0.0001% to 0.10%,
Mn: 0.001% to 1.00%,
P: 0.0001% to 0.050%,
S: 0.0005% to 0.060%,
Al: 0.0001% to 0.010%,
N: 0.0001% to 0.0040%,
O: 0.0010% to 0.050%, Ti: 0.001% to 0.50%, and
a balance of Fe and unavoidable impurities.

6. The product for enameling as set forth in claim 5, wherein the steel sheet further comprises one or both of Nb: 0.0005% to 1.5% and B: 0.0010% to 0.0050%, where Nb+B×10: 0.020% to 0.2%.

7. A product for enameling comprising a pressed steel sheet having on the surface thereof an oxide film of 0.10 μm to 400 μm in thickness comprising oxides of components of the steel sheet, wherein the steel sheet comprises, in mass %, C: 0.0001% to 0.040%,
Si: 0.0001% to 0.50%,
Mn: 0.001% to 2.00%, P: 0.0001% to 0.10%,
S: 0.0001% to 0.060%,
Al: 0.0001% to 0.10%,
N: 0.0001% to 0.015%, and
O: 0.0001% to 0.070%,
further comprises one or more of
Ni: 0.01% to 2.00%,
Co: 0.0005% to 2.00%,
Cr: 0.001% to 2.00%,
Cu: 0.01% to 2.00%,
Mo: 0.0001% to 2.00%,
Ti: 0.0005% to 0.50%,
where Ni+Co+Cr/2+Cu+Mo+Ti: 0.010% to 8.0%,
and a balance being Fe and unavoidable impurities, and
wherein the oxide film includes layers of FeO, $Fe_3O_4$ and $Fe_2O_3$ of such thicknesses that $FeO>Fe_3O_4>Fe_2O_3$, and (FeO thickness)/($Fe_3O_4$ thickness)≧1.1, and ($Fe_3O_4$ thickness)/($Fe_2O_3$ thickness)≧1.1.

8. An enameled product, comprising a steel sheet of the composition of claim 1, an oxide film comprising oxides of components of the steel sheet formed on the steel sheet and an enamel layer formed on the oxide film, wherein an interface between the oxide film and the steel sheet has irregularities including valleys of an average depth of 5.0 μm or less and an average interval between the valleys of 15 μm or less.

9. An enameled product, comprising a steel sheet of the composition of claim 1, an oxide film comprising oxides of components of the steel sheet formed on the steel sheet and an enamel layer formed on the oxide film, wherein the enamel layer contacts a region of the oxide film composed mainly of FeO.

10. A method of producing a product for enameling as set forth in claim 1, comprising:

pressing a steel sheet of the composition of claim 1 into a desired shape;
degreasing the pressed product; and
heating the pressed product for 0.1 to 100 min at a temperature of 500 to 1000° C. in an atmosphere having an oxygen concentration of 5% or greater.

11. A method of producing a product for enameling comprising:

pressing a steel sheet of the composition of claim 1 into a desired shape; and
heating the pressed product without degreasing for 0.1 to 100 min at a temperature of 500 to 1000° C. in an atmosphere having an oxygen concentration of 5% or greater.

12. The method of producing a product for enameling as set forth in claim 10, comprising subjecting a steel sheet having a roughness of Ra=0.3 to 5.0 μm to heating and pressing.

13. A method of producing an enameled product comprising:

using electrostatic coating to apply to a product for enameling produced in accordance with claim 10 a glaze comprising, in mass %, one or more of Ti oxide: 0.1% to 20% as metallic Ti equivalent, K oxide: 0.1% to 10% as metallic K equivalent, B oxide: 0.1% to 10% as metallic B equivalent, and Na oxide: 0.1% to 10% as metallic Na equivalent, where Ti+Na+K+B is within the range of 0.1% to 50%; and
firing the glaze.

14. The product for enameling as set forth in claim 1, wherein the oxide film has a thickness of 0.5 to 100 μm.

15. The product for enameling as set forth in claim 1, wherein the oxide film has a thickness of 1.0 to 50 μm.

* * * * *